US010308018B2

(12) United States Patent
Miura et al.

(10) Patent No.: US 10,308,018 B2
(45) Date of Patent: Jun. 4, 2019

(54) PRINTING APPARATUS AND METHOD OF CONTROLLING PRINTHEAD

(71) Applicant: CANON KABUSHIKI KAISHA, Tokyo (JP)

(72) Inventors: Yosuke Miura, Tokyo (JP); Keiji Tomizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/724,521

(22) Filed: Oct. 4, 2017

(65) Prior Publication Data

US 2018/0111370 A1 Apr. 26, 2018

(30) Foreign Application Priority Data

Oct. 25, 2016 (JP) ..... 2016-208839

(51) Int. Cl.
*B41J 29/38* (2006.01)
*B41J 2/045* (2006.01)

(52) U.S. Cl.
CPC ..... *B41J 2/04591* (2013.01); *B41J 2/0455* (2013.01); *B41J 2/0458* (2013.01); *B41J 2/04541* (2013.01); *B41J 2/04563* (2013.01); *B41J 2/04568* (2013.01); *B41J 2/04586* (2013.01); *B41J 2/04598* (2013.01)

(58) Field of Classification Search
USPC ..... 347/5, 9, 14
See application file for complete search history.

(56) References Cited

U.S. PATENT DOCUMENTS 6,309,051 B1 * 10/2001 Koitabashi ..... B41J 2/04528 347/48
6,409,315 B2 6/2002 Komuro
6,827,413 B1 * 12/2004 Kawatoko ..... B41J 2/04506 347/14
8,226,190 B2 7/2012 Hirayama et al.

FOREIGN PATENT DOCUMENTS

JP 10-044416 A 2/1998
JP 2010-155452 A 7/2010

* cited by examiner

*Primary Examiner* — Lam S Nguyen
(74) *Attorney, Agent, or Firm* — Venable LLP

(57) ABSTRACT

A printing apparatus comprises: a plurality of printing elements; driving circuits that have at least one source follower transistor and correspond to each of the plurality of printing elements; and a control unit configured to, in a case where a number of printing elements driven simultaneously does not exceed a predetermined number, perform a first control for driving the at least one source follower transistor by a fixed pulse width irrespective of the number of printing elements driven simultaneously, and, in a case where the number of printing elements driven simultaneously exceed the predetermined number, perform a second control for changing a pulse width to drive the at least one source follower transistor based on the number of printing elements driven simultaneously.

9 Claims, 10 Drawing Sheets

PRINTING APPARATUS AND METHOD OF CONTROLLING PRINTHEAD

BACKGROUND OF THE INVENTION

Field of the Invention

The present invention relates to a printing apparatus and a method of controlling a printhead.

Description of the Related Art

In printing apparatuses that cause ink to discharge by heating the ink by energy generation elements (hereinafter referred to as heaters) arranged for discharge ports of a printhead, it is preferable to drive as many heaters as possible simultaneously in order to perform a print by the printhead at a high speed. However, when many heaters are driven simultaneously, current flowing to the wiring increases. As a result, there are cases where a voltage drop due to parasitic resistance of the wiring increases and it is impossible to generate the desired thermal energy in the heaters. Deterioration of image quality occurs because a variation of the thermal energy causes the volume of ink that is discharged to vary.

In order to solve such a problem, in Japanese Patent Laid-Open No. H10-44416, for a voltage difference across the two terminals of a heater between when as many heaters as possible are driven simultaneously (all nozzles) and when only one heater (one bit) is driven (single nozzle), a wiring resistance adjustment is conducted in accordance with the distance thereof. Also, in conjunction with an elongation of a substrate (one inch for example) in recent years, heater driving circuit configuration adjustment (employing a source follower configuration) is performed in Japanese Patent Laid-Open No. 2010-155452.

By adjusting wiring resistance or making the heater driving circuit (transistor) a source follower configuration as described above, the thermal energy provided to the heaters is fixed even if there is a voltage fluctuation and thereby the volume of ink droplets that is discharged is stabilized.

When using a source follower configuration for the heater driving unit, voltage across the heater will be fixed at all times. However, because it is necessary to consider a voltage drop due to wiring resistance in wiring (flexible or printing element substrate) from the main body to the heaters in relation to the heater driving power supply voltage, it is necessary that the voltage across the heater be designed to be lower than the heater driving power supply voltage. In other words, when the voltage applied to the drain of the transistor falls below the gate voltage, the voltage supplied to the heaters will not be fixed. It is thought that heat will be produced proportionally to the voltage loss, and the printhead will heat up more than necessary. Accordingly, this leads to a bottleneck in acceleration because it becomes important to suppress heat within the printhead as much as possible from the perspective of throughput.

SUMMARY OF THE INVENTION

According to one aspect of the present invention, there is provided a printing apparatus comprising: a plurality of printing elements; driving circuits that have at least one source follower transistor and correspond to each of the plurality of printing elements; and a control unit configured to, in a case where a number of printing elements driven simultaneously does not exceed a predetermined number, perform a first control for driving the at least one source follower transistor by a fixed pulse width irrespective of the number of printing elements driven simultaneously, and, in a case where the number of printing elements driven simultaneously exceed the predetermined number, perform a second control for changing a pulse width to drive the at least one source follower transistor based on the number of printing elements driven simultaneously.

According to another aspect of the present invention, there is provided a method for controlling a printhead, the method comprising: the printhead including a plurality of printing elements and driving circuits which have at least one source follower transistor and correspond to each of the plurality of printing elements; in a case where a number of printing elements driven simultaneously does not exceed a predetermined number, perform a first control for driving the at least one source follower transistor by a fixed pulse width irrespective of the number of printing elements driven simultaneously, and, in a case where the number of printing elements driven simultaneously does exceed the predetermined number, perform a second control for changing a pulse width to drive the at least one source follower transistor based on the number of printing elements driven simultaneously.

By virtue of the present application invention, it is possible to achieve both keeping voltage across a heater fixed and suppressing deterioration of throughput.

Further features of the present invention will become apparent from the following description of exemplary embodiments (with reference to the attached drawings).

DESCRIPTION OF THE EMBODIMENTS

Figure 1:
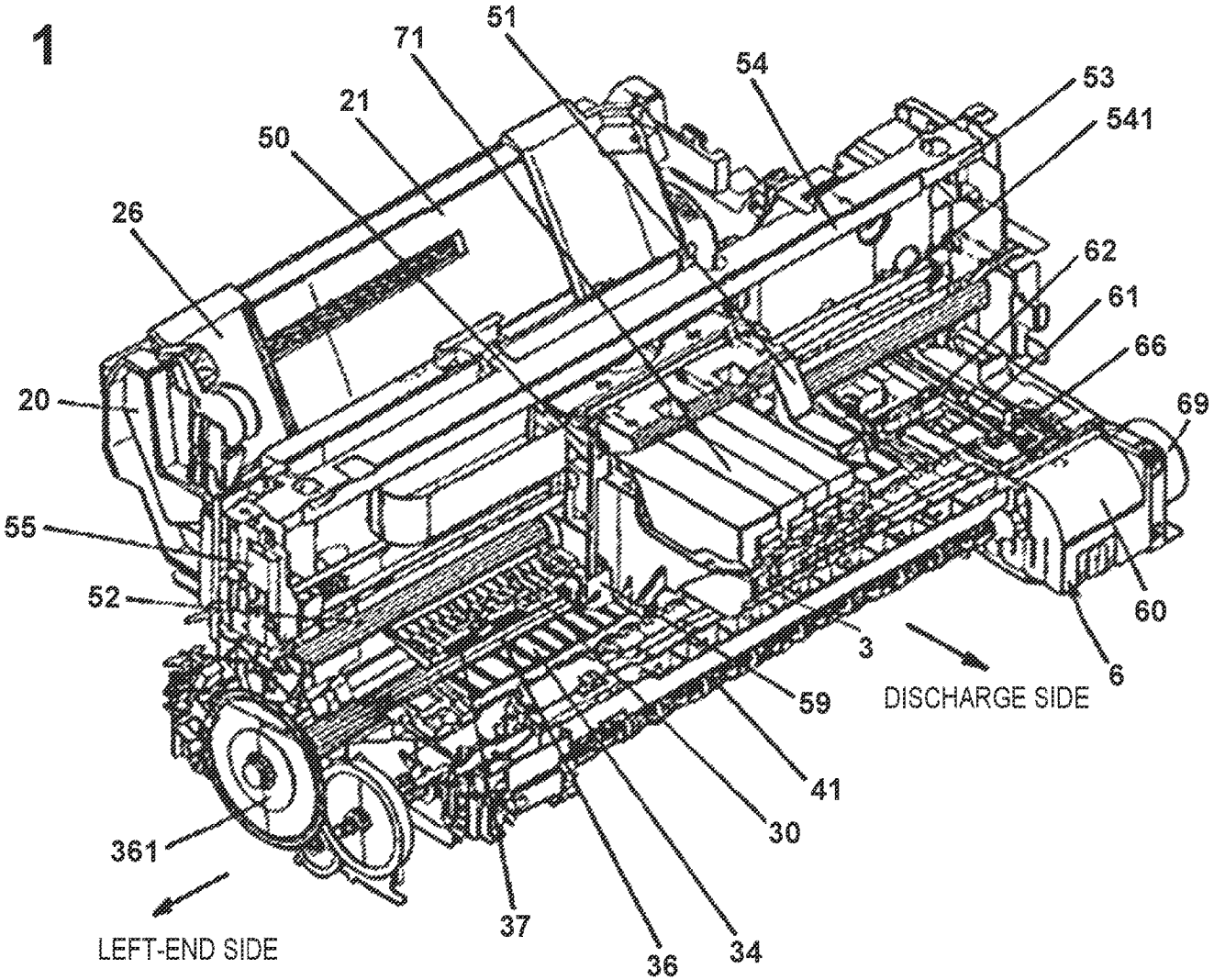
FIG. 1 is a view illustrating an example of a configuration of an inkjet printing apparatus according to the present invention.

Hereinafter, description is given regarding an embodiment of the present invention with reference to the figures.

Below, more specific descriptions are given in detail for preferred embodiments of the present invention with reference to the attached drawings. However, relative arrangements of configuration elements, and the like, recited in this embodiment are not intended to limit the scope of the invention thereto, unless specifically stated.

Note that in this specification, "print" represents forming not only meaningful information such as characters and shapes, but also meaningless information. Furthermore, it is assumed that "print" broadly represents cases in which an image, design, or pattern is formed on a printing medium irrespective of whether or not it is something that a person can visually perceive, and cases in which a medium is processed.

Also, it is assumed that "printing medium" broadly represents not only paper used in a typical printing apparatus, but also things that can receive ink such as cloths, plastic films, metal plates, glass, ceramics, wood materials, and hides.

Furthermore, similarly to the foregoing definition of "print", "ink" (also referred to as "liquid") should be broadly interpreted. Accordingly, it is assumed that "ink" represents liquids that by being applied to a printing medium can be supplied in the forming of images, designs, patterns, or the like, processing of printing mediums, or processing of ink (for example, insolubilization or freezing of a colorant in ink applied to a printing medium).

Furthermore, it is assumed that "print element", unless specified otherwise, means a discharge port and an element that produces energy that is used for discharge of ink and a fluid channel that communicates therewith collectively.

Furthermore, it is assumed that "nozzle", unless specified otherwise, means a discharge port and an element that produces energy that is used for discharge of ink and a fluid channel that communicates therewith collectively.

An element substrate for a printhead (a head substrate) used below does not indicate a mere substrate consisting of a silicon semiconductor but rather indicates a configuration in which elements, wiring, and the like are disposed.

Furthermore, "on the substrate" means not only simply on top of the element substrate, but also the surface of the element substrate, and the inside of the element substrate in the vicinity of the surface. Also, "built-in" in the present invention does not mean that separate elements are simply arranged as separate bodies on a substrate surface, but rather means that the elements are formed and manufactured integrally on the element board by a semiconductor circuit manufacturing process.

For an inkjet printhead (hereinafter referred to as a printhead) having the most important features of the present invention, on a printing element substrate of the printhead, a plurality of printing elements and a driving circuit that drives these printing elements are implemented on the same substrate. Configuration may be taken such that, a plurality of printing element substrates are integrated in a printhead, and these element substrates have a cascade connection structure for example. Accordingly, this printhead is able to achieve a print width that is relatively long. Accordingly, the printhead is used not only in a serial type printing apparatus that is commonly found, but also in a printing apparatus equipped with a full-line printhead whose print width corresponds to the width of the printing medium. Also, the printhead is used in large format printers that use printing mediums of a large size such as A0 and B0 in serial type printing apparatuses.

Accordingly, firstly, a printing apparatus in which the printhead of the present invention is used is described.

[Device Configuration]

FIG. 1 is a view illustrating an example of a configuration of an inkjet method printing apparatus (hereinafter referred to as a printing apparatus) that the present invention can be applied to. FIG. 1 illustrates an embodiment of a typical inkjet printing apparatus and illustrates a printing apparatus of a scan method. Note that limitation is not made to this configuration and it is possible to apply the present invention to a printing apparatus equipped with a full-line type inkjet printhead (hereinafter referred to as a printhead) for example. Also, the present invention is not limited to this inkjet method and may be applied to a printing apparatus of another method.

In FIG. 1, the printing apparatus according to the present embodiment is equipped with a feed mechanism, a paper conveyance mechanism, a discharge mechanism, a carriage unit, and the like. In the present embodiment, description of a printing apparatus that performs a print by discharging ink from a discharge port of a printhead 3 to a printing medium based on image information is given as an example.

The printhead 3 is mounted as a print unit on a carriage 50 that moves back and forth (main scanning movement). It becomes possible for the printhead 3 to be released by a head set lever 51. Furthermore, one or a plurality of ink tanks 71 corresponding to each color of ink are removably mounted to the printhead 3. Also, the printhead 3 comprises a temperature sensor 59 for detecting its own temperature. As a printing medium, various materials may be used such as a print paper, a plastic sheet, cloth, and unwoven fabric if a sheet type image printing is possible. In the description below, a sheet type printing medium is referred to as "a sheet". Hereinafter, the configuration of the printing apparatus is described for each mechanism.

The feed mechanism is configured by attaching a pressing plate 21 for stacking sheets, a feed roller for feeding sheets, a separation roller for separating sheets, a return lever for returning sheets to the stacking position, a moveable side guide 26 for indicating the edge of the sheets, and the like to a feed base 20. A feed tray for holding stacked sheets P is attached to an exterior covering of the feed base 20 or the printing apparatus.

Regarding operation of the feed mechanism, the pressing plate 21 is released by a pressing plate cam (not shown) and the separation roller is released by a control cam in a normal standby state. Furthermore, the return lever returns a sheet P to the stacking position, and also is held in the stacking position such that it blocks the stacking port at a time of stacking so that the sheet P does not enter the interior of the printer. From this state, when the feed operation starts, firstly, the separation roller contacts the feed roller by driving of a motor. Then, the return lever is released and the pressing plate 21 contacts the feed roller. In this state, feeding of the sheet P is started. The sheet P is restricted by the front side separation unit (not shown) arranged in the feed base 20, and only a predetermined number of sheets P are fed to a nip unit between the feed roller and the separation roller. The fed sheets P are separated by the nip unit and only the top sheet is conveyed (fed).

When the sheet P reaches a conveyance roller pair comprising a conveyance roller 36 and a pinch roller 37 described later, the pressing plate 21 is released by a pressing plate cam (not shown) and the separation roller is released by a control cam (not shown). Also, the return lever is returned to the stacking position by a control cam (not shown). At that time, the sheet that has reached the nip unit between the feed roller and the separation roller is returned to the stacking position by the return lever.

The paper conveyance mechanism is attached to a chassis 55 comprising bent raised metal plates. The paper conveyance mechanism has a PE sensor (paper edge detection sensor) and the conveyance roller 36 which conveys the sheet P. The conveyance roller 36 is structured by ceramic micro-particles coating the surface of a metal shaft, and is attached to the chassis 55 by pivotally supporting both ends of a metal shaft portion by bearings (not shown).

A plurality of pinch rollers 37 that follow a rotation are disposed to contact the conveyance roller 36. The pinch roller 37 is held in a pinch roller holder 30 and creates conveyance power for the sheet P by being pressed against the conveyance roller 36 by a pinch roller spring (not shown). Here, the rotation shaft of the pinch roller holder 30 is pivotally supported by the bearing of the chassis 55, and rotates about this rotation shaft. Furthermore, a paper guide flapper and a platen 34 that guide sheets are disposed at an inlet of the paper conveyance mechanism to which the sheet P is conveyed. Also, in the pinch roller holder 30, a PE sensor lever (not shown) is arranged in order to transmit detection of the leading edge and the trailing edge of the sheet P to the PE sensor (not shown).

The platen 34 is positioned attached to the chassis 55. The paper guide flapper (not shown), fits with the conveyance roller 36, can centrally rotate a sliding bearing unit (not shown), and is positioned in contact with the chassis 55. Furthermore, at the downstream sheet conveyance side direction of the conveyance roller 36, the printhead 3 is arranged as a print unit for printing an image based on image information.

The sheet P is conveyed along the top surface of the platen 34 by the pinch roller 37 following the rotation when the conveyance roller 36 rotates by the conveyance motor. A rib which is a conveyance guide surface (vertical direction nominal position) is formed on the platen 34. The rib manages a gap (distance) between the sheet P and the printhead 3 as well as regulates cockling (corrugation) of the sheet P by cooperating with a discharge mechanism described later. Thereby, image quality degradation due to cockling of the sheet portion printed by the printhead 3 is prevented. Driving of the conveyance roller 36 is performed by a rotational force of a conveyance motor comprising a DC motor being transferred to a pulley 361 arranged on the conveyance roller shaft by a timing belt 541.

The carriage unit has the carriage 50 on which the printhead 3 is mounted and which moves back and forth. The carriage 50 is supported and guided such that it can move back and forth (main scanning) along a guide shaft 52 and a guide rail 54 installed in a direction intersecting (normally perpendicularly to) the direction of conveyance of the sheet P. The guide shaft 52 configures a guidance mechanism for guiding back and forth movement of the carriage 50. The guide rail 54 also has a function for maintaining a distance (a gap) between the printhead 3 and the sheet P at an appropriate value by supporting a rear end portion of the carriage 50. The guide shaft 52 is configured by an axis member attached to the chassis 55, and the guide rail 54 is formed built into part of the chassis 55. A thin sliding sheet 53 made from SUS or the like is stretched over the part of the guide rail 54 over which the carriage 50 slides, and achieves a reduction of a sliding sound.

The carriage unit prevents evaporation of liquid such as ink by causing the printhead 3 to move to a capping position, and performing capping by a cap 61. A recovery motor 69 operates as a driving source of the cap 61 or the like. Additionally, it performs cleaning of the nozzle surface by a blade 62. For the blade 62, cleaning is performed by a blade cleaner 66. Also, the printhead 3 causes ink to discharge from the nozzle and causes ink clogging to be reduced by operation of a pump 60 equipped within a recovery mechanism 6.

Two discharge rollers are arranged in the discharge mechanism. In each discharge roller, a spur is pressed so as to be able to follow rotation. By causing each discharge roller to rotate in synchronism with the conveyance roller 36, the sheet P that is printed is ejected to the outside of the main body of the printing apparatus. In the present embodiment, the discharge roller is attached to the platen 34. The discharge roller of the upstream side of the conveyance direction is configured by arranging a plurality of rubber units (discharge roller rubber) on a metal shaft. A first discharge roller (not shown) is driven by drive from the conveyance roller 36 being transferred via an idler gear. A second discharge roller 41 is configured by an elastic body such as a plurality of elastomers being attached to a resin shaft. The second discharge roller 41 is driven by drive being transferred from the first discharge roller (not shown) via an idler gear.

By the foregoing configuration, the sheet P printed on by the printhead 3 in the carriage unit is pinched in the nip unit of each spur and the discharge roller, is ejected to the outside of the main body of the printing apparatus, and is placed on a discharge tray. The discharge tray has a divided structure comprising a plurality of members which are pulled out when used. Also, the discharge tray is formed so as to become higher towards a leading edge, and is formed to have high side edges, and thereby it improves stackability of ejected sheets P and prevents scraping of the printing surface of the sheet P.

[Control Configuration]

Figure 2:
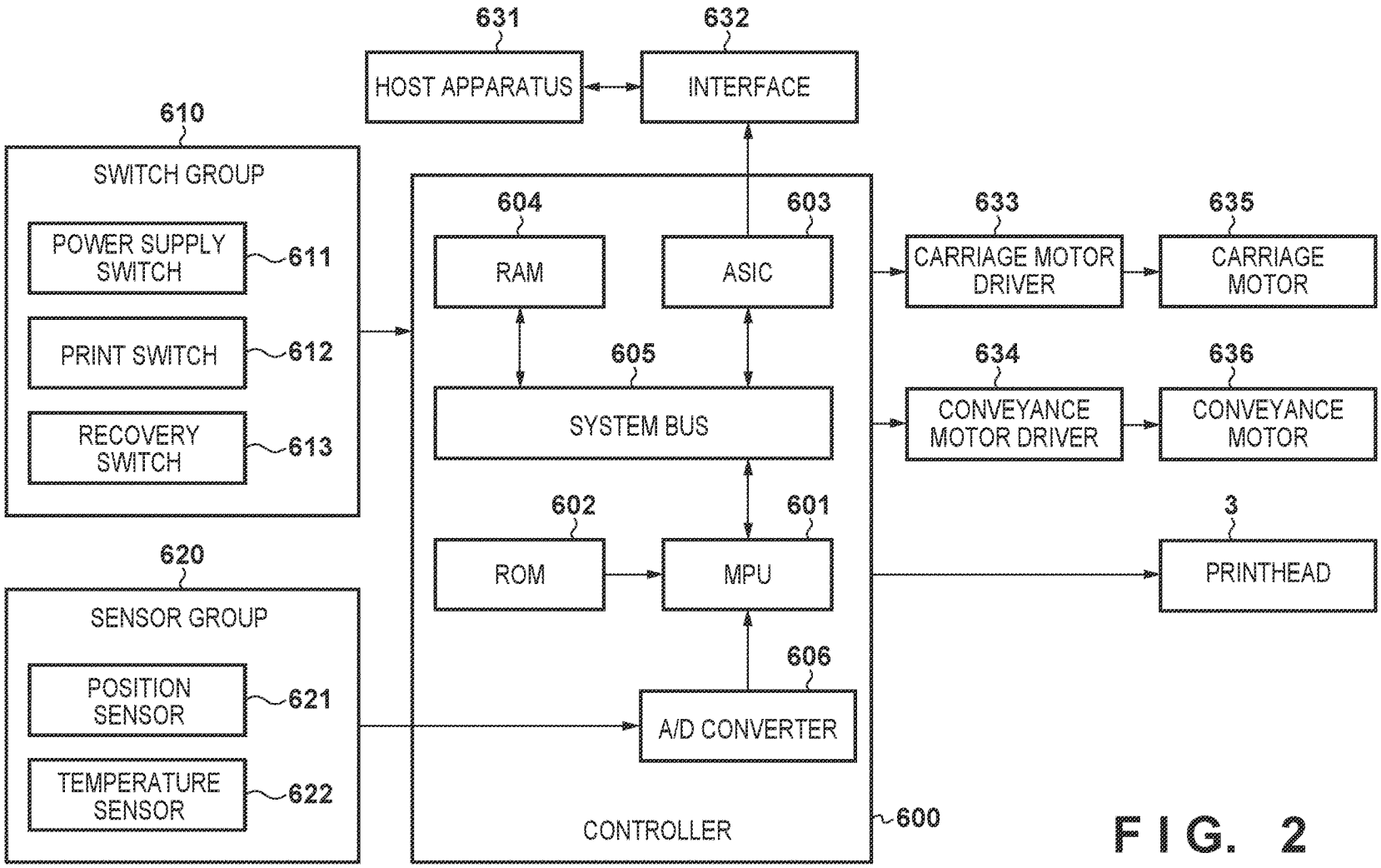
FIG. 2 is a view illustrating an example of a control configuration of the printing apparatus according to the present application invention.

FIG. 2 is a block diagram illustrating a control configuration of the printing apparatus illustrated in FIG. 1.

As illustrated in FIG. 2, a controller 600 is configured by an MPU 601, a ROM 602, an application-specific integrated circuit (ASIC) 603, a RAM 604, a system bus 605, an A/D converter 606, and the like. The ROM 602 stores programs corresponding to various control sequences, particular tables, and other fixed data. The ASIC 603 generates control signals for control of a carriage motor 635, control of a conveyance motor 636, and control of the printhead 3. The ASIC 603 performs control of a signal pulse width described later. The RAM 604 is used as an image data loading region or a work region for execution of programs. The system bus 605 performs reception of data by mutually connecting with the MPU 601, the ASIC 603, and the RAM 604. The A/D converter 606 takes an analog signal as input from a sensor group described below, performs an A/D conversion on it, and supplies the digital signal to the MPU 601.

Also, in FIG. 2, a host apparatus 631 is an external information processing apparatus such as a PC which is a supply source of image data. Image data, commands, statuses, and the like are transmitted/received by packet communication via an interface (I/F) 632 between the host apparatus 631 and the printing apparatus. Note, configuration may be taken such that a USB interface is further included separately from the network interface as the interface 632, and such that bit data or raster data transferred serially from the host can be received.

A switch group 610 is configured from a power supply switch 611, a print switch 612, a recover switch 613, and the like.

A sensor group 620 is a sensor group for detecting an apparatus state and is configured from a position sensor 621, a temperature sensor 622, and the like. Also, a photosensor that detects a remaining amount of ink is arranged.

A carriage motor driver 633 is a carriage motor driver that drives the carriage motor 635 in order to cause the carriage 50 to scan back and forth. A conveyance motor driver 634 drives the conveyance motor 636 in order to convey the sheet P.

The ASIC 603, at a time of print scanning by the printhead 3, transfers data for driving a heating element (heater for ink discharge) to the printhead 3 while directly accessing the storage region of the RAM 604. In addition, various display units configured by an LCD or an LED are equipped as a user interface in the printing apparatus.

[Printhead Configuration]

Figure 3:
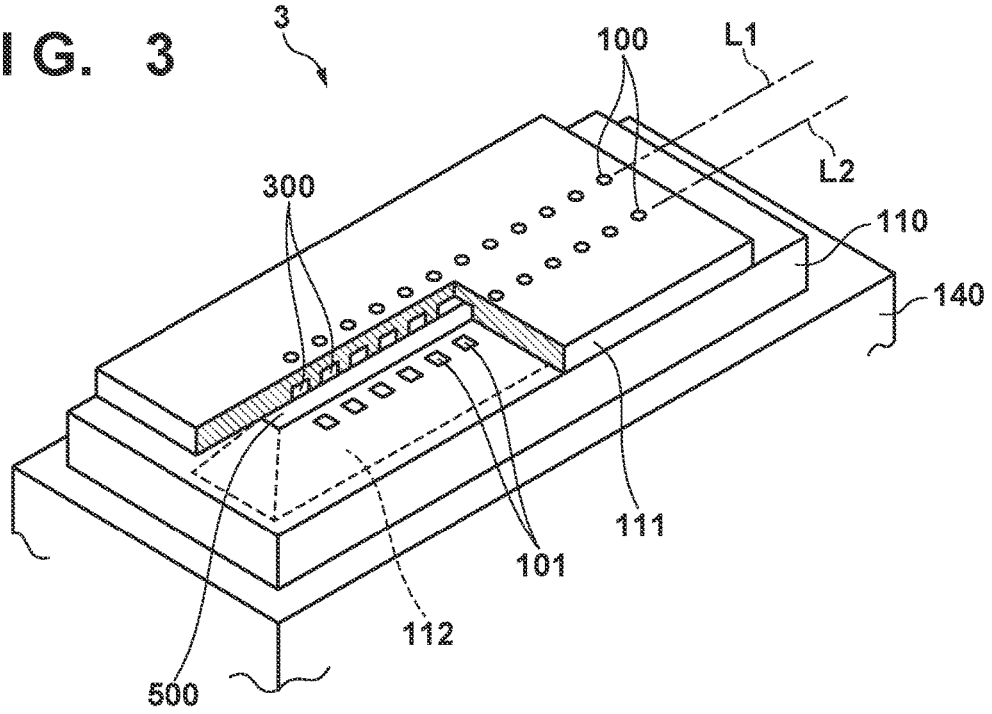
FIG. 3 is a view illustrating an example of a configuration of an inkjet printhead.

Description is given regarding the details of the printhead 3 according to the present invention by using FIG. 3. FIG. 3 is a view illustrating an example of a configuration of a printing element substrate arranged on the printhead 3 according to the present application invention.

An energy generation element array, in which a plurality of heaters 101 that can be energized via the wiring are arrayed, is formed on a silicon semiconductor substrate 110 of the printhead 3. The wiring can also be applied by either single layer wiring or multilayer wiring. A channel formation member (coating resin material) 111 is arranged on the silicon semiconductor substrate 110, and a plurality of discharge ports 100 corresponding to each of the plurality of heaters 101 are formed in the channel formation member 111. The prepared silicon semiconductor substrate 110 is a semiconductor substrate (printing element substrate) of silicon or the like, and the heaters 101 are formed by a material such as tantalum silicon nitride (TaSiN).

A bubbling phenomenon occurs within the liquid when thermal energy generated by a heater 101 is applied to a liquid such as ink. Also, an ink droplet from the discharge port 100 is discharged by the bubbling energy. In inkjet printheads of recent years, the density of an array of heaters has been increased and their number has been increased to improve printing density (resolution) and to increase printing speed.

Although not illustrated, a driver that drives a respective heater 101, a shift register of the same number of bits as there are heaters, and a latch circuit that temporarily stores print data outputted therefrom are further arranged on the silicon semiconductor substrate 110. Note that the shift register is for sending, in parallel, image data inputted serially to each driver.

The discharge port 100 is arrayed at a predetermined pitch P in two discharge port lines L1 and L2. Furthermore, the discharge ports 100 of the discharge port line L1 side and the discharge ports 100 of the discharge port line L2 side are respectively displaced by a half pitch (P/2) in the direction in which they are arranged. The heater 101 also is arranged at the same pitch as the discharge port 100.

On the silicon semiconductor substrate 110, a common liquid chamber 112 and a hole shaped ink supply port 500 are formed, and between the silicon semiconductor substrate 110 and the channel formation member 111, a plurality of ink channels (bubbling chambers) 300 respectively joining the plurality of discharge ports 100 are formed. The channel formation member 111 has a wall of ink channels 300, and forms the ink channels 300 by contacting the silicon semiconductor substrate 110. Ink supplied through the common liquid chamber 112 and the ink supply port 500 is introduced into respective ink channels 300 from an ink supply port member 140. The ink within an ink channel 300 bubbles by generated heat of the heater 101 corresponding to that ink channel 300, and is discharged from the discharge port 100 corresponding to the ink channel 300 by the bubbling energy.

[Heater Driving Circuit]

Figure 4:
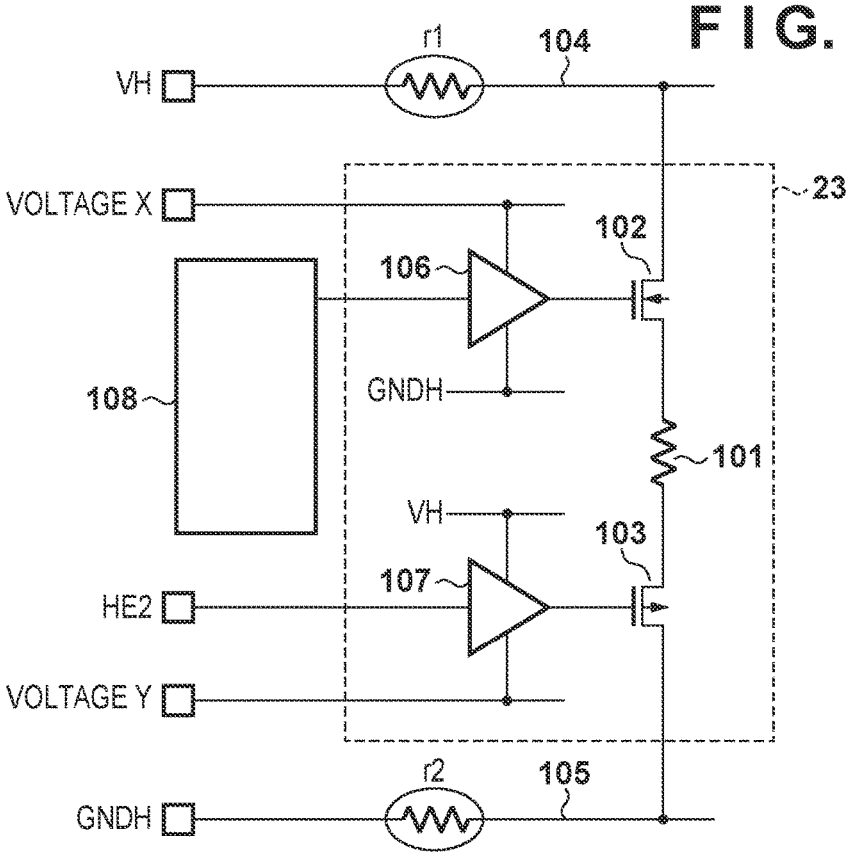
FIG. 4 is a view illustrating an example of a configuration of a heater driving circuit.
Figure 5A:
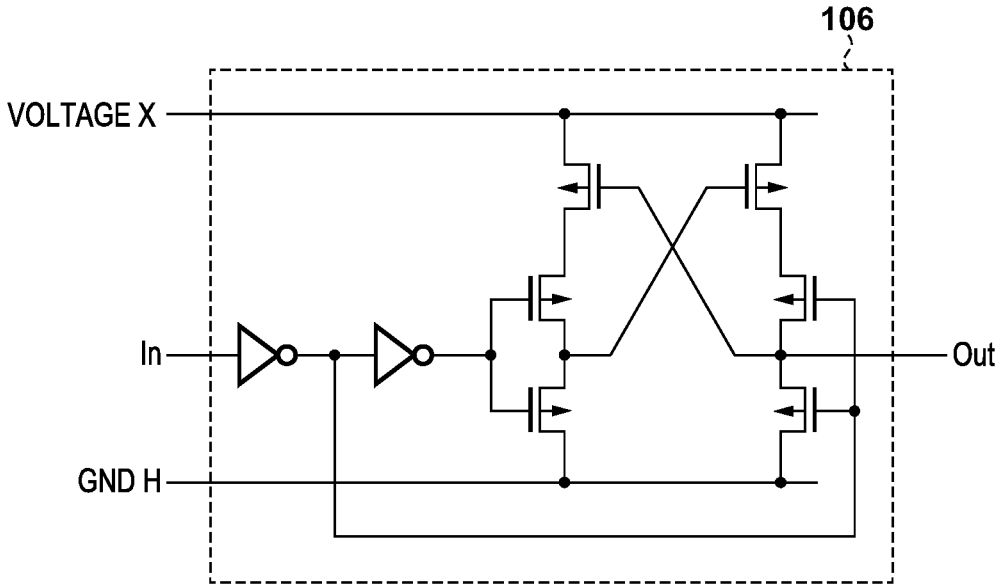
FIGS. 5A and 5B are views illustrating examples of a configuration of a voltage converter circuit.
Figure 5B:
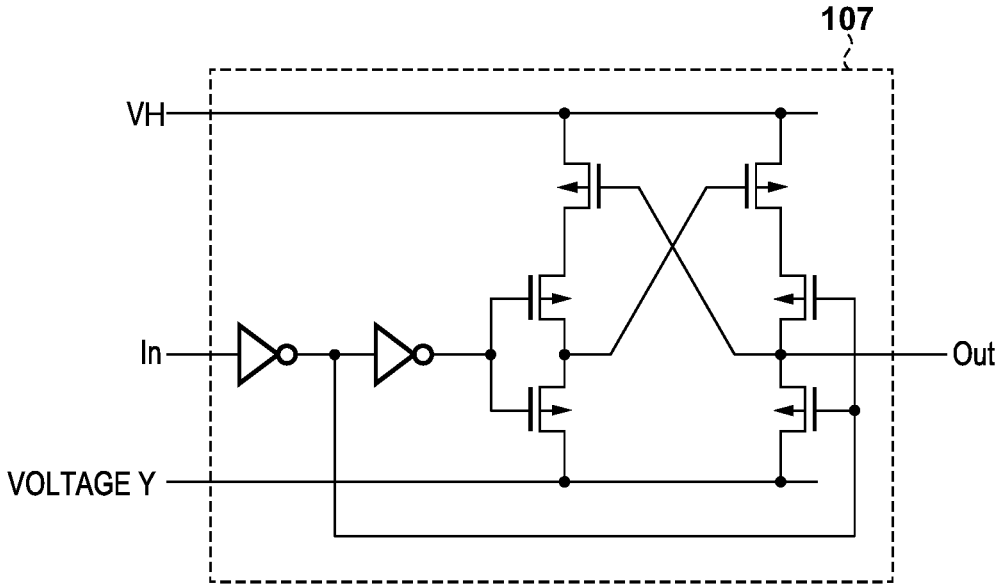

FIG. 4 is an explanatory view of a heater driving circuit 23. Circuitry of a single heater 101 is represented in FIG. 4 in order to simplify the explanation. Accordingly, a plurality of heaters 101 and heater driving circuits 23 corresponding thereto are actually disposed on the silicon semiconductor substrate 110 as described above. One terminal of the heater 101 is connected to a source terminal of an NMOS transistor 102. The other terminal of the heater 101 is connected to a source terminal of a PMOS transistor 103. Drain terminals of the NMOS transistor 102 and the PMOS transistor 103 are connected to a power supply wiring 104 and a power supply wiring 105 respectively. The output of a voltage converter circuit 106 illustrated in FIG. 5A is inputted to the gate terminal of the NMOS transistor 102. The output of a voltage converter circuit 107 illustrated in FIG. 5B is inputted to the gate terminal of the PMOS transistor 103. Voltages from an external power supply are inputted via input terminals that the silicon semiconductor substrate 110 comprises to the power supply wiring 104 and 105, and voltages of a high electric potential side VH and a low electric potential side GNDH respectively are applied. These electric potentials are inputted via the input terminals from the outside, and become the voltage VH of a high voltage side wiring and the voltage GNDH of a low voltage side wiring. The voltage GNDH, to use another expression, is a ground voltage. Note, there is a wiring resistance r1 in the power supply wiring 104 and a wiring resistance r2 in the power supply wiring 105.

The heater driving circuit 23 is equipped with the two voltage converter circuits 106 and 107. The voltage converter circuit 106 takes an output signal of a selection circuit 108 as input and outputs to the gate of the NMOS transistor 102. The voltage converter circuit 107 takes a signal HE 2 as input and outputs to the gate of the PMOS transistor 103. Note, the circuitry for generation of signals that the voltage converter circuit 106 and the voltage converter circuit 107 take as input is not limited to this form and configuration.

A configuration of the voltage converter circuit 106 is illustrated in FIG. 5A. The voltage converter circuit 106 takes voltages X and GNDH as inputs, and performs a conversion of the amplitude of the input signal. The voltage converter circuit 106 generates a gate voltage for putting the NMOS transistor 102 in an on state based on the voltage X inputted from outside of the silicon semiconductor substrate 110. The voltage X is a voltage that is different from the power supply voltage GNDH supplied to the drain of the PMOS transistor 103 from outside of the silicon semiconductor substrate 110.

A configuration of the voltage converter circuit 107 is illustrated in FIG. 5B. The voltage converter circuit 107 takes voltages Y and VH as inputs, and performs a conversion of the amplitude of the input signal. The voltage converter circuit 107 generates a gate voltage for putting the PMOS transistor 103 in an on state based on the voltage Y inputted from outside of the silicon semiconductor substrate 110. The voltage Y is a voltage that is different from the power source voltage VH supplied to the drain of the NMOS transistor 102. A gate voltage for putting the PMOS transistor 103 in an on state and a gate voltage for putting the NMOS transistor 102 in an on state are voltages decided based on a power supply VH supplied to the drain of the NMOS transistor 102 or a power supply GNDH supplied to the drain of the PMOS transistor 103. The selection circuit 108 outputs a signal according to image data to the voltage converter circuit 106. The voltage converter circuit 106 converts the input signal into a driving voltage (driving signal) of the NMOS transistor 102. Meanwhile, the voltage converter circuit 107 converts the input signal into a driving voltage (driving signal) of the PMOS transistor 103. In this way, the voltage converter circuits 106 and 107 are circuits that increase the signal amplitude of inputted signals.

Figure 6:
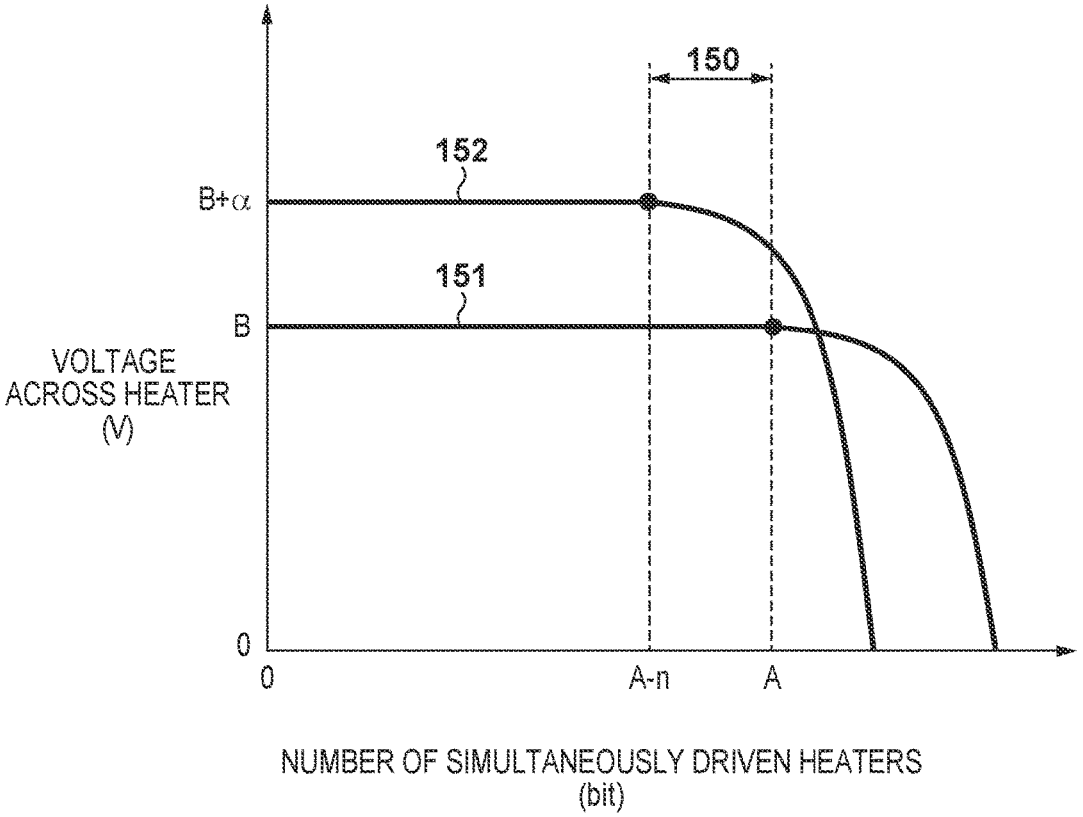
FIG. 6 is a view for describing voltage across a heater for a number of simultaneously driven heaters.

FIG. 6 is a graph representing a transition of voltage across a heater according to the number of simultaneously driven heaters. In FIG. 6, the ordinate is indicated as the voltage across the heater [V] and the abscissa is indicated as the number of simultaneously driven heaters [bit]. A graph 151 illustrates a conventional voltage across the heater design value. According to the graph 151, it is possible for the voltage across the heater to be kept fixed for up to the number of simultaneously driven heaters A by the heater driving circuits (hereinafter referred to as voltage compensation circuits) supplying a stable voltage to the heaters 101 described in FIG. 4. However, when the number of heaters becomes greater than or equal to the number of simultaneously driven heaters A, the range (hereinafter referred to as a voltage compensation range) in which it is possible to keep the voltage across the heater fixed is exceeded due to a wiring resistance voltage drop. As a result, it becomes impossible to keep the voltage across the heater fixed, and the voltage across the heater becomes lower. The number of simultaneously driven heaters A is decided during design by calculating a worst voltage drop value from a wiring resistance of wiring to the heaters 101 for the printhead 3 on the whole and the current value that flows due to the maximum number of heaters to be driven simultaneously. For this reason, the number of heaters driven simultaneously A will not be exceeded in normal usage, and the voltage across the heater will be kept fixed at all times.

However, due to compensate for the worst voltage drop value, the voltage across the heater will be a value that is significantly lower than the heater driving power supply voltage (voltage VH) that is actually being applied. At that time, when the voltage applied to the drain of the transistor falls below the gate voltage, the voltage supplied to the heater will not be fixed. Also, that portion, as loss, will become heat, and it is envisioned that the printhead will heat up more than necessary.

Accordingly, in the present invention, as in the graph 152, the concept of setting the applied voltage (an applied voltage such that, in all envisioned usage environments, a voltage change substantially does not arise) is changed from what was conventional, and heat generation due to voltage loss is reduced by setting applied voltages including those in a region exceeding the voltage compensation range. Also, in the region in which the voltage compensation range is exceeded, a correction of a voltage input period is applied. By this, the objective described above, specifically keeping the voltage across the heater fixed while also suppressing a reduction in throughput due to a temperature rise is resolved.

Specifically, a voltage so as to result in B+α is applied to a source follower (the gate of the NMOS transistor 102) that is above the heater 101. Here, for the voltage B+α, a value such that a loss of voltage does not occur is set for the NMOS transistor 102. By this, regarding the voltage compensation range, it ceases to be possible to keep the voltage across the heater fixed at the number of simultaneously driven heaters A-n as illustrated in the graph 152 of FIG. 6 when considering a voltage drop due to the resistance of wiring to the heaters 101 for the printhead 3 on the whole. Here, a control region 150 where control of the pulse width for driving the heater 101 is necessary is made to be the region from the number of simultaneously driven heaters A-n to the number of simultaneously driven heaters A which is the minimum number at which the voltage across the heater needs to be kept fixed. Also, in this control region 150, the amount by which the voltage across the heater deviates from the fixed amount is corrected by pulse width modulation (hereinafter referred to as PWM control). By this, it becomes possible to keep the voltage across the heater fixed up to the number of simultaneously driven heaters A.

Figure 8A:
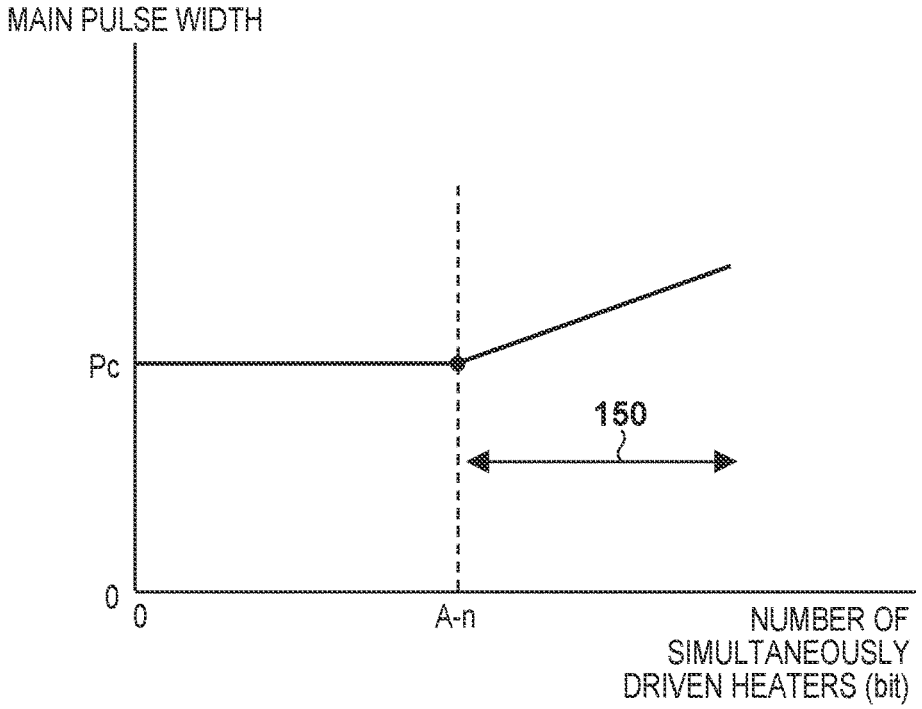
FIGS. 8A and 8B are views for describing a relationship of a pulse width and the number of heaters that are driven simultaneously.
Figure 8B:
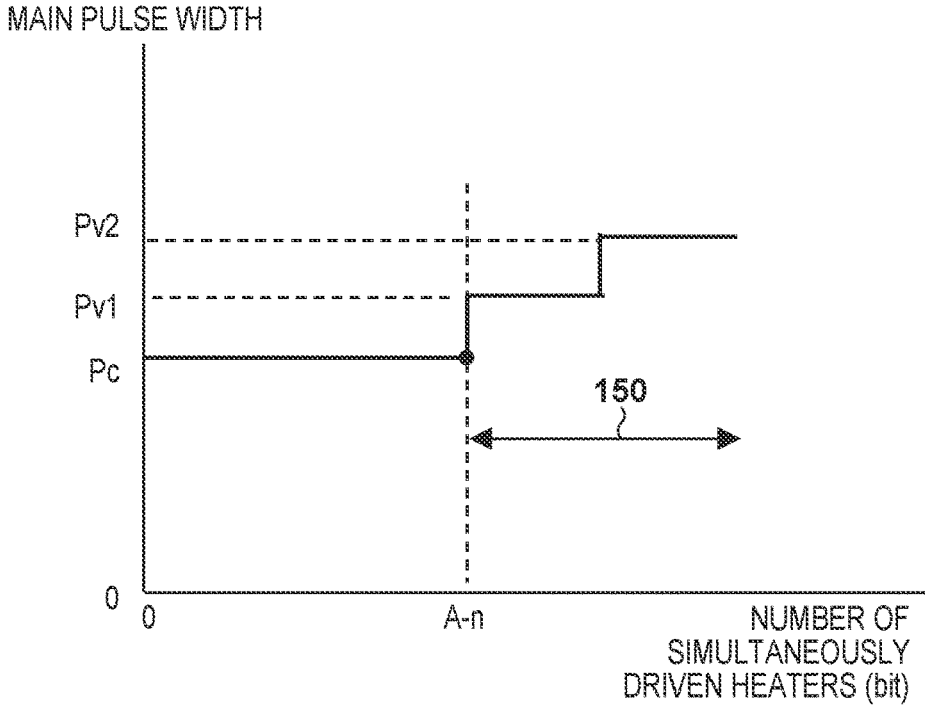

FIG. 8A and FIG. 8B are for describing a relationship of the number of simultaneously driven heaters and a pulse width. In FIG. 8A and FIG. 8B, the ordinate indicates a main pulse width and the abscissa indicates the number of simultaneously driven heaters. As illustrated in FIG. 8A, the pulse width is Pc (fixed) when the number of simultaneously driven heaters is less than A-n. When the number of simultaneously driven heaters is greater than or equal to A-n, the pulse width is lengthened in accordance with the number of simultaneously driven heaters increasing. Note that control may be taken so that the pulse width is lengthened stepwise to Pc, Pv1, Pv2 as illustrated in FIG. 8B.

Here, description is given regarding a case of a voltage compensation up to the number of simultaneously driven heaters A. However, rather than being limited to this configuration, configuration may be taken such that the number of simultaneously driven heaters actually increases beyond the number of simultaneously driven heaters A, and PWM control is performed in conjunction with reaching the region outside of the voltage compensation range.

Figure 7A:
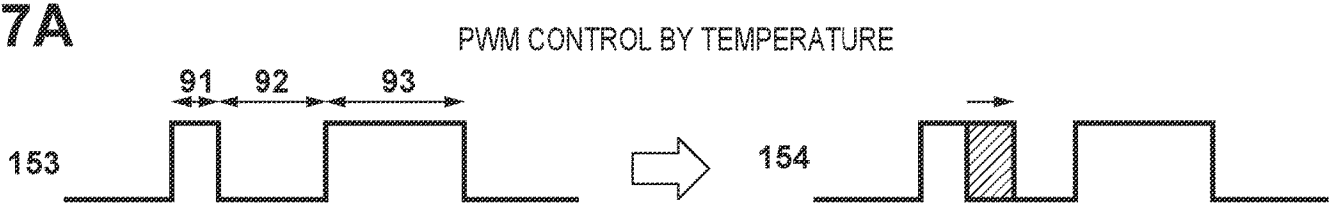
FIGS. 7A, 7B, and 7C are views for describing a pulse control method.
Figure 7B:
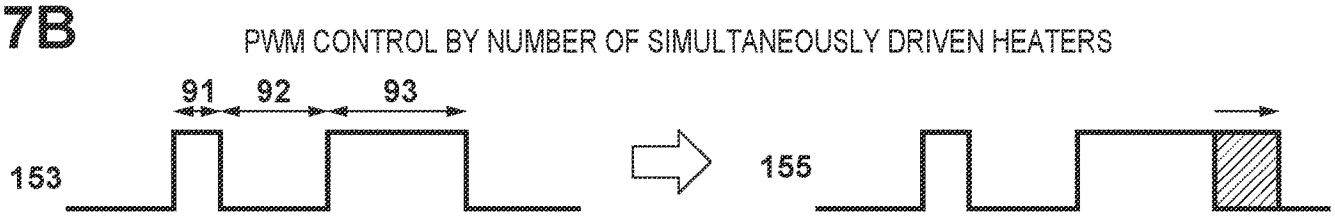
Figure 7C:
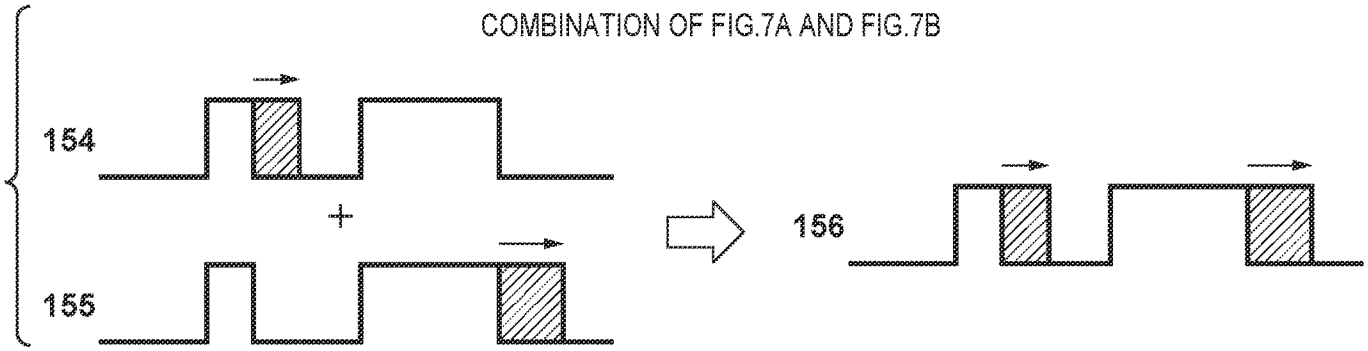

FIG. 7A to FIG. 7C are views illustrating one example of a PWM control method. In the present embodiment, the heater driving pulse comprises a first pulse 91 in which the width is controlled depending on the temperature of the printhead 3, a second pulse 93 in which the width is controlled depending on the number of simultaneously driven heaters, and an interval 92 positioned between the first pulse 91 and the second pulse 93. In other words, the heater driving pulse here is assumed to be of a double pulse form. Note, although description is given using an example of a double pulse, a single pulse where only the second pulse is present may be used, as necessary.

Description is given regarding control when the number of simultaneously driven heaters reaches the control region 150. In the case of the example of FIG. 6, this corresponds to a case where the number of simultaneously driven heaters reaches A-n. In such a case, the first pulse 91 and the interval 92 are modulated in combination with the temperature change as with the change from the heater driving pulse 153 to the heater driving pulse 154 according to the temperature of the printhead 3, as in FIG. 7A. In other words, the pulse width of the first pulse 91 increases in accordance with the temperature change. Note, it is possible to detect the temperature of the printhead 3 by the temperature sensor 59 in the case of the example of the device configuration illustrated in FIG. 1.

Next, the second pulse 93 is modulated in combination with the number of simultaneously driven heaters as with the change from the heater driving pulse 153 to the heater driving pulse 155, as in FIG. 7B, in order to correct for the amount that the voltage dropped outside of the voltage compensation range. In other words, as the number of simultaneously driven heaters increases, the pulse width of the second pulse 93 increases. In the present embodiment, although an example in which the pulse width is linked to the number of simultaneously driven heaters is illustrated, limitation is not made to this configuration. For example, configuration may be such that the voltage across the heater is monitored and PWM control is performed when a state in which the voltage is not kept fixed is entered.

Finally, as in FIG. 7C, PWM control so as to achieve the heater driving pulse 156 is performed by combining FIG. 7A and FIG. 7B.

Figure 9:
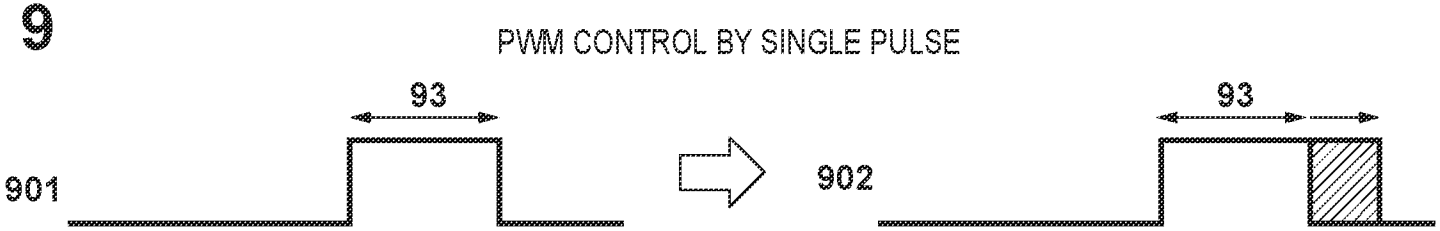
FIG. 9 is a view for describing a pulse control method.

Note, in the range in which PWM control is performed, it is necessary to have a pulse width that fits into a discharge cycle (driving cycle) and to maintain at a minimum a voltage level at which the heaters 101 can discharge. Note, the pulse that drives the heater 101 is not limited to a double pulse, and may be a single pulse as illustrated in FIG. 9. In the case of FIG. 9, only the second pulse 93 is present in the heater driving pulse 901, and control is such that the pulse width of the second pulse 93 is increased.

Furthermore, although in the present invention, using the example of FIG. 4, description is given regarding a voltage compensation circuit in which transistors above and below the heater 101 are provided in a source follower configuration, limitation is not made to this. The present invention is valid in circuit configurations having a similar effect such as are illustrated in FIG. 10A to FIG. 10D. In these configurations, since a voltage converter circuit in which though the voltage compensation range is narrower, only one transistor is arranged, there is the advantage that a smaller circuit scale suffices. In FIG. 10A to FIG. 10D, the voltage converter circuit 106 (107) illustrated in FIG. 4 is omitted in order to simplify the explanation.

Figure 10A:
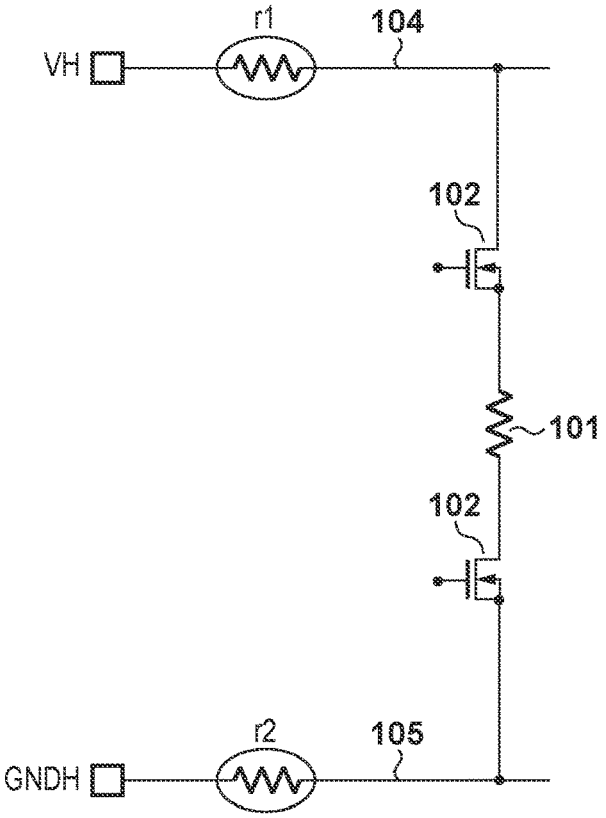
FIGS. 10A, 10B, 10C, and 10D are views illustrating an example of a configuration of each heater driving circuit.

In FIG. 10A, the transistors connected to the two sides of the heater 101 are NMOS transistors 102. The NMOS transistor 102 connected between the heater 101 and the power supply wiring 104 is a source follower transistor. The NMOS transistor 102 connected between the heater 101 and the power supply wiring 105 is a source-ground connection.

Figure 10B:
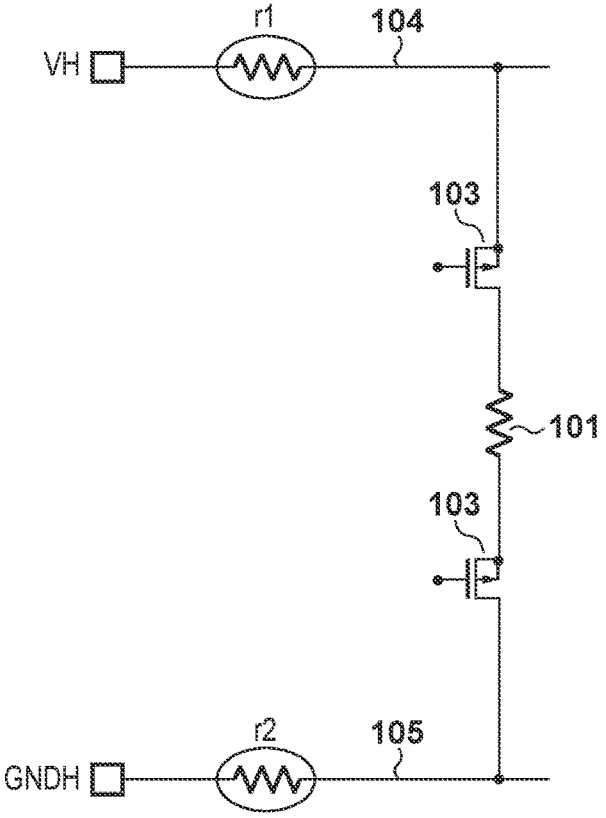

In FIG. 10B, the transistors connected to the two sides of the heater 101 are PMOS transistors 103. The PMOS transistor 103 connected between the heater 101 and the power supply wiring 105 is a source follower transistor. The PMOS transistor 103 connected between the heater 101 and the power supply wiring 104 is a source-ground connection.

Figure 10C:
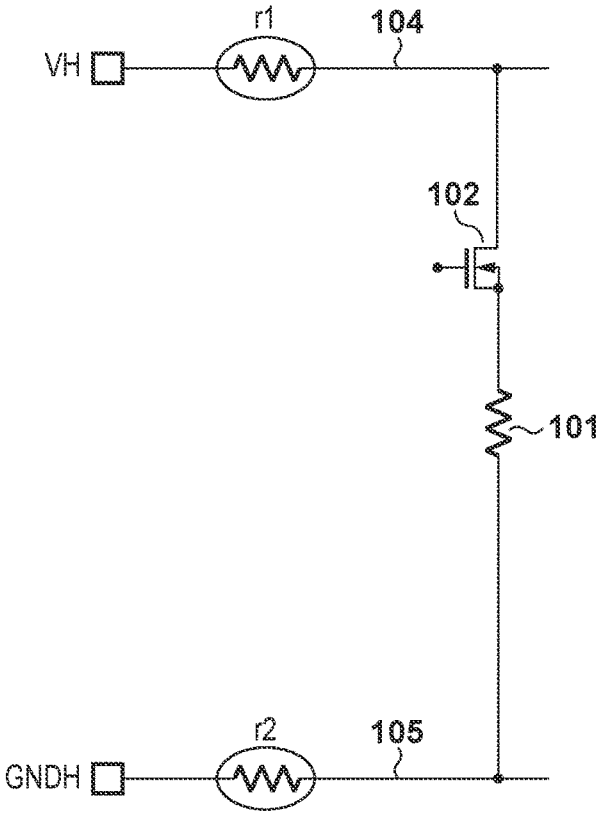

In FIG. 10C, the NMOS transistor 102 is connected between the heater 101 and the power supply wiring 104. The NMOS transistor 102 connected between the heater 101 and the power supply wiring 104 is a source follower transistor.

Figure 10D:
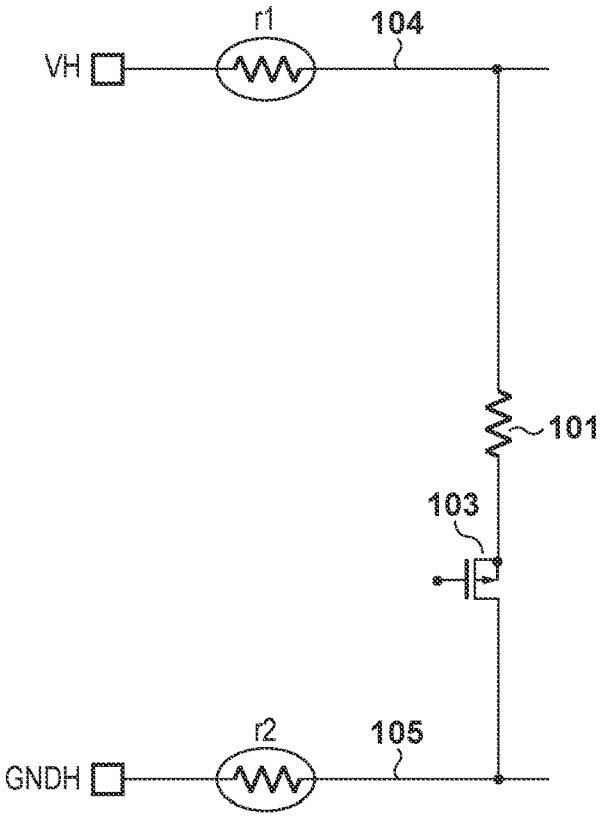

In FIG. 10D, the PMOS transistor 103 is connected between the heater 101 and the power supply wiring 105. The PMOS transistor 103 connected between the heater 101 and the power supply wiring 105 is a source follower transistor. As described above, the driving circuit that drives the heater is equipped with at least one source follower transistor.

When the number of heaters that are simultaneously driven exceeds a predetermined number, the voltage across the heater is kept fixed by performing PWM control in conjunction therewith, and the voltage across the heater can be made higher than what was possible conventionally, and voltage loss can be reduced and heating up of the head suppressed. By this, it is possible to achieve both keeping voltage across a heater fixed and suppressing deterioration of throughput.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-208839, filed Oct. 25, 2016, which is hereby incorporated by reference herein in its entirety.

What is claimed is:

1. A printing apparatus comprising:

a plurality of printing elements;

driving circuits that have at least one source follower transistor and correspond to each of the plurality of printing elements; and a control unit configured to, in a case where a number of printing elements driven simultaneously does not exceed a predetermined number, perform a first control for driving the at least one source follower transistor by a fixed pulse width irrespective of the number of printing elements driven simultaneously, and, in a case where the number of printing elements driven simultaneously exceeds the predetermined number, perform a second control for changing a pulse width to drive the at least one source follower transistor based on the number of printing elements driven simultaneously, wherein the predetermined number is determined such that the driving circuits keep a voltage across the printing elements fixed.

2. The printing apparatus according to claim 1, wherein the control unit, in the second control, drives the at least one source follower transistor by a first pulse width when the number of printing elements driven simultaneously is a first value, and drives the at least one source follower transistor by a second pulse width that is longer than the first pulse width when the number of printing elements driven simultaneously is a second value greater than the first value.

3. The printing apparatus according to claim 1, wherein each of the driving circuits includes an NMOS transistor connected between a power supply line and a corresponding printing element.

4. The printing apparatus according to claim 1, wherein each of the driving circuits includes a PMOS transistor connected between a ground line and a corresponding printing element.

5. The printing apparatus according to claim 1, wherein each of the driving circuits includes an NMOS transistor connected between a power supply line and a corresponding printing element, and a PMOS transistor connected between a ground line and the corresponding printing element.

6. The printing apparatus according to claim 1, wherein the at least one source follower transistor is driven by a double pulse including a pre-pulse and a main-pulse, and the control unit controls the width of the pre-pulse based on a temperature.

7. The printing apparatus according to claim 1, further comprising a printhead, wherein the printhead includes the plurality of printing elements and source follower connected transistors corresponding to each of the plurality of printing elements.

8. A method for controlling a printhead, the method comprising:

providing the printhead including a plurality of printing elements and driving circuits which have at least one source follower transistor and correspond to each of the plurality of printing elements;

in a case where a number of printing elements driven simultaneously does not exceed a predetermined number, perform a first control for driving the at least one source follower transistor by a fixed pulse width irrespective of the number of printing elements driven simultaneously, and in a case where the number of printing elements driven simultaneously does exceed the predetermined number, perform a second control for changing a pulse width to drive the at least one source follower transistor based on the number of printing elements driven simultaneously, wherein the predetermined number is determined such that the driving circuits keep a voltage across the printing elements fixed.

9. The printing apparatus according to claim 1, wherein each of the driving circuits includes an NMOS transistor having a drain and a gate, and the control unit performs the second control in a case where voltage applied to the drain falls below voltage applied to the gate.

* * * * *